US005675110A

United States Patent [19]

Gyre et al.

[11] Patent Number: 5,675,110

[45] Date of Patent: Oct. 7, 1997

[54] DUAL AMMUNITION FEEDING SYSTEM FOR A FIRE ARM AND METHOD FOR FEEDING DIFFERENT AMMUNITION TYPES USING A COMMON TRANSFER MECHANISM

[75] Inventors: Christian Gyre, Chameyrat; Daniel Vieillefond, Ladignac, both of France

[73] Assignee: CTA International, Versailles, France

[21] Appl. No.: 499,687

[22] Filed: Jul. 7, 1995

[30] Foreign Application Priority Data

Jul. 22, 1994 [FR] France ..... 94 09095

[51] Int. Cl.[6] ..... F41A 9/30; F41A 9/34

[52] U.S. Cl. ..... 89/33.04; 89/33.16

[58] Field of Search ..... 89/34, 33.04, 33.14, 89/33.16, 33.17, 46

[56] References Cited

U.S. PATENT DOCUMENTS

| | | | |
|---|---|---|---|
| 3,995,527 | 12/1976 | Schiele et al. | 89/33.04 |
| 4,612,843 | 9/1986 | Marcon et al. | 89/33.04 |
| 4,781,100 | 11/1988 | Baldwin | 89/33.04 |
| 5,109,751 | 5/1992 | Hagen et al. | 89/33.16 |
| 5,115,714 | 5/1992 | Muller et al. | 89/33.16 |
| 5,212,338 | 5/1993 | Maher | 89/45 |

FOREIGN PATENT DOCUMENTS

| | | | |
|---|---|---|---|
| 338301 | 10/1989 | European Pat. Off. | 89/46 |
| 2 005 386 | 4/1979 | United Kingdom . | |
| 2 203 224 | 10/1988 | United Kingdom . | |

*Primary Examiner*—Stephen M. Johnson
*Attorney, Agent, or Firm*—Oliff & Berridge

[57] ABSTRACT

An ammunition feed system for a small or medium caliber fire arm, of the type comprising a double ammunition rack (G1, G2) for different munitions (M1, M2), a loading device belonging to the weapon to load the munition one by one and an intermediate (9) device to transfer the munitions (M1, M2) from the rack (G1 or G2) towards the loading device. Each rack (G1, G2) comprises a conveyor (25) having two endless chains (27) which is selectively coupled to a star-wheel (37) which forms the intermediate transfer device (9). This wheel may revolve in two opposite direction in order to extract the munitions (M1, M2) from one rack (G1, G2) or to bring the munitions (M1, M2) back to the original rack.

21 Claims, 3 Drawing Sheets

DUAL AMMUNITION FEEDING SYSTEM FOR A FIRE ARM AND METHOD FOR FEEDING DIFFERENT AMMUNITION TYPES USING A COMMON TRANSFER MECHANISM

BACKGROUND OF THE INVENTION

The present invention relates to an ammunition feed system for a small or medium caliber fire arm, of the type comprising at least one ammunition storage device, a loading device belonging to the weapon to load the munitions one by one into a firing chamber, and an intermediate device to transfer the munitions from the storage device to the loading device of the weapon.

In a conventional feed system, the munitions are chain-linked together on a conveyor chain which is stored in a container forming an ammunition rack. The intermediate transfer device between the rack and the loading device of the weapon includes a one-way drive that meshes with the chain to bring the munitions up to the loading device of the weapon.

As a general rule, a fire arm can fire different munitions which are selected according to the nature of the target to be hit. In practice, a target which appears within the aiming range of the weapon is not always identifiable in advance, given that the effectiveness of the fire is conditioned by a suitable choice of the munition to be fired. To solve this problem, one solution consists in providing two ammunition racks containing different munitions. These two racks are placed on either side of the weapon and work respectively with two intermediate devices which transfer the munitions from one or the other of the racks up to the loading device of the weapon.

Such a solution is not satisfactory technically and it has the notable disadvantage of being cumbersome.

SUMMARY OF THE INVENTION

One aim of the invention is to bring a new solution to the problem explained above whilst procuring other advantages.

To this end, the invention proposes a feed system of the afore-mentioned type which is characterised in that the storage device includes a single container in which two ammunition racks have been arranged each containing different munitions which are not necessarily chain-linked together. Each rack includes a two-way conveyor which supports and moves the munitions inside the rack. The intermediate transfer device also comprises a two-way transport device common to the two racks and designed either to transfer the munitions from one or the other of the racks towards the loading device of the weapon, or to bring back to their original rack those munitions which are in the process of being transferred towards the loading device of the weapon. The feed system also comprises structure to select and control the two-way transport device of the intermediate transfer device simultaneously with one or the other of the conveyors of the two racks.

According to a preferred embodiment of the invention, the two-way transport device of the intermediate transfer device may include a starwheel, and the conveyor of each rack may be an endless chain conveyor.

According to another characteristic of the invention, the structure to select and control the starwheel simultaneously with one or the other of the conveyors of the two racks, may include a drive wheel integral in rotation with the shaft supporting the starwheel having two drive wheels working respectively with the two conveyors via two coupling devices. The drive wheel may also include a single control device to act on the two coupling devices in such a manner as to mesh the drive wheel of the starwheel with one or the other of the drive wheels of the two conveyors.

As a general rule, the starwheel is rotated in one or the other direction either by an auxiliary driving source, or by the driving source used to ensure the operation of the weapon.

According to a significant advantage of the invention, the feed system enables the transfer of the munitions between the weapon and the two racks to be carried out in a manner which is absolutely reversible according to the rotational direction of the starwheel.

According to a further advantage of the invention, the feed system is particularly well adapted for the transfer of telescoped munitions.

BRIEF DESCRIPTION OF THE DRAWINGS

Other advantages, characteristics and details of the invention will become apparent from the following explanatory description made with reference to the appended drawings, given merely by way of illustration, wherein.

DETAILED DESCRIPTION OF PREFERRED EMBODIMENTS

Figure 1:
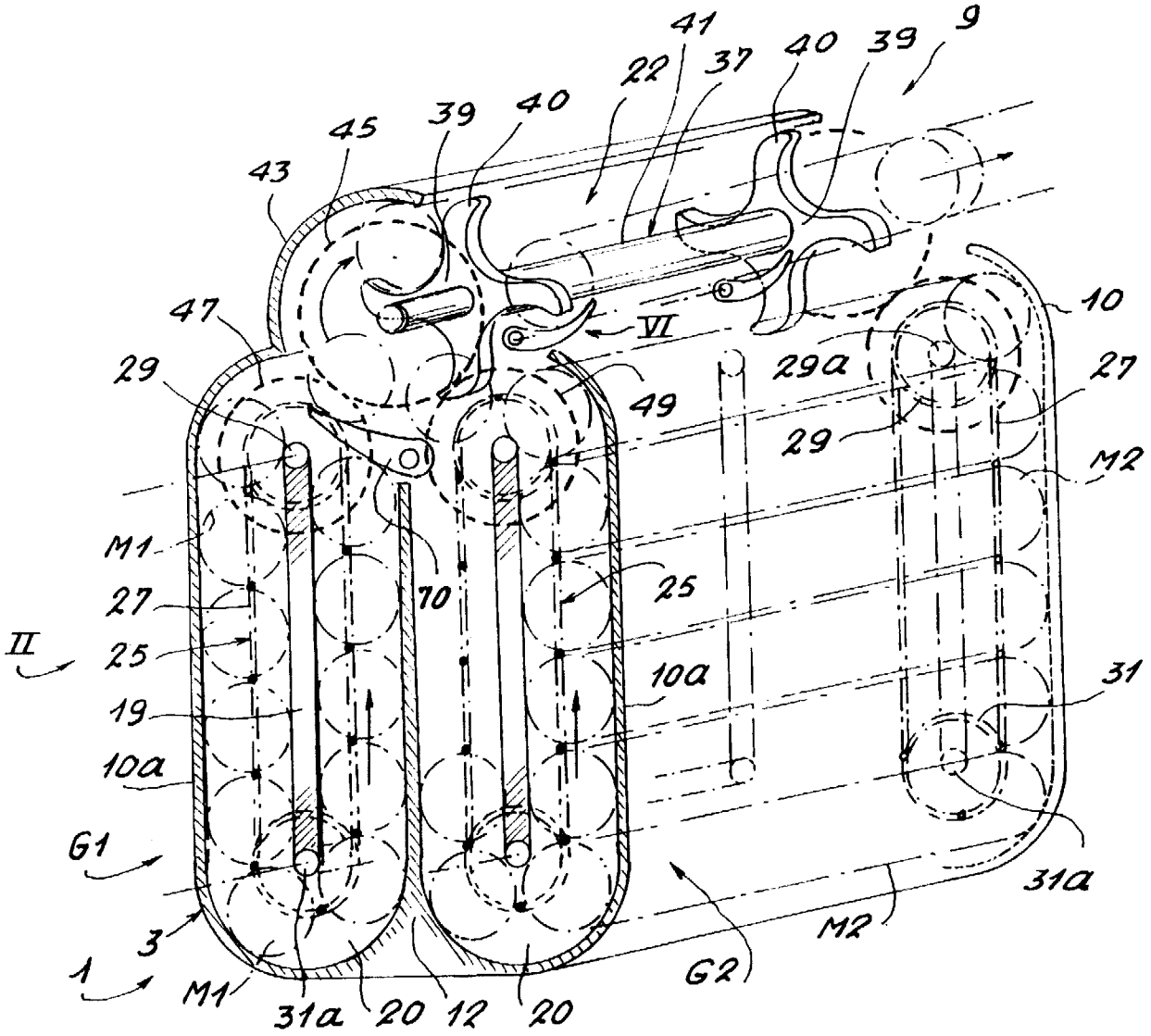
FIG. 1 is a partial skeleton view in perspective of a double ammunition rack for the feed system according to the invention.
Figure 2:
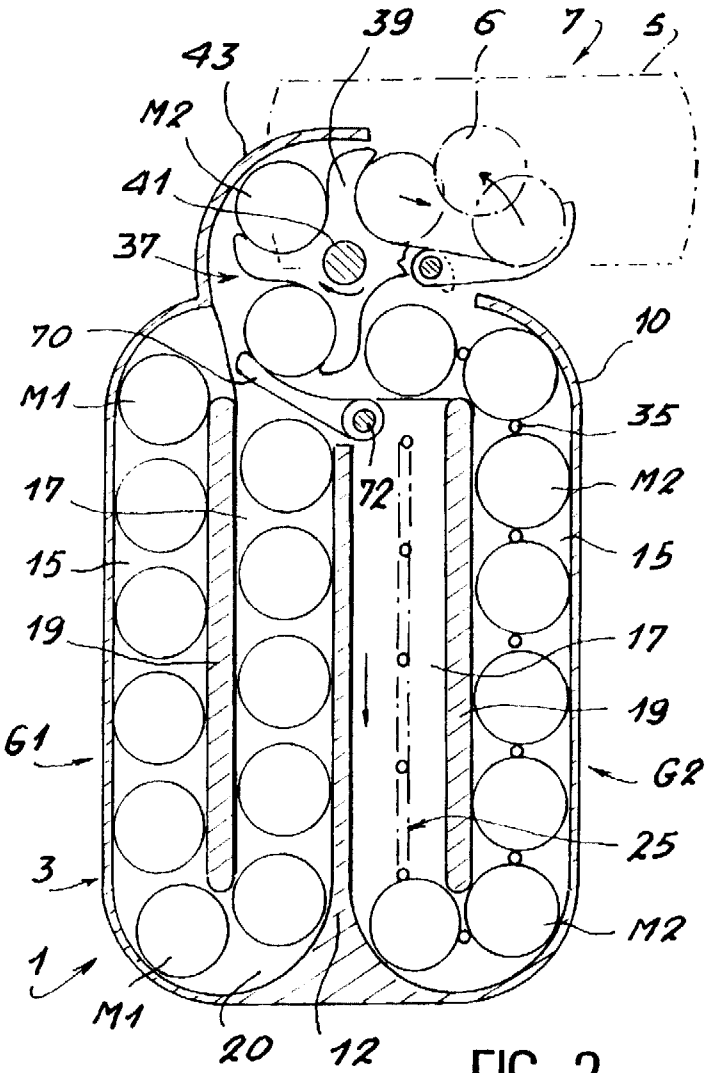
FIG. 2 is a view according to the arrow II in FIG. 1 to illustrate the operation of the rack.
Figure 3:
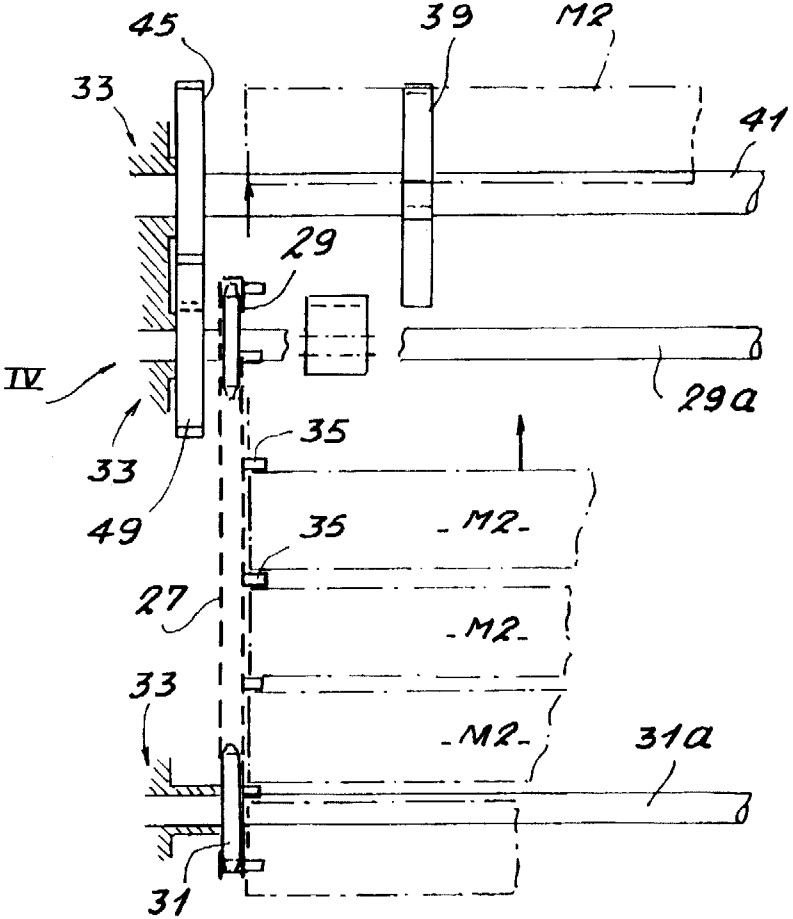
FIG. 3 is a partial skeleton view of a conveyer housed in one of the racks of the feed system.
Figure 4:
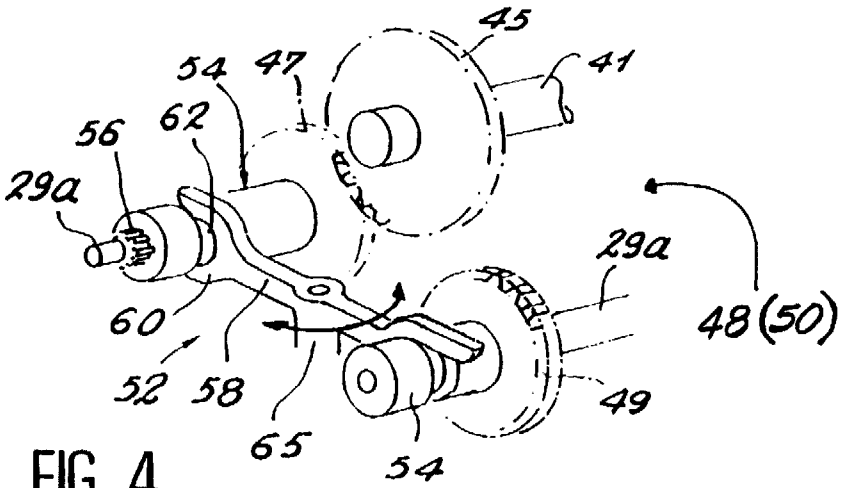
FIG. 4 is a partial perspective view of the part of FIG. 3 indicated by the arrow IV.
Figure 5:
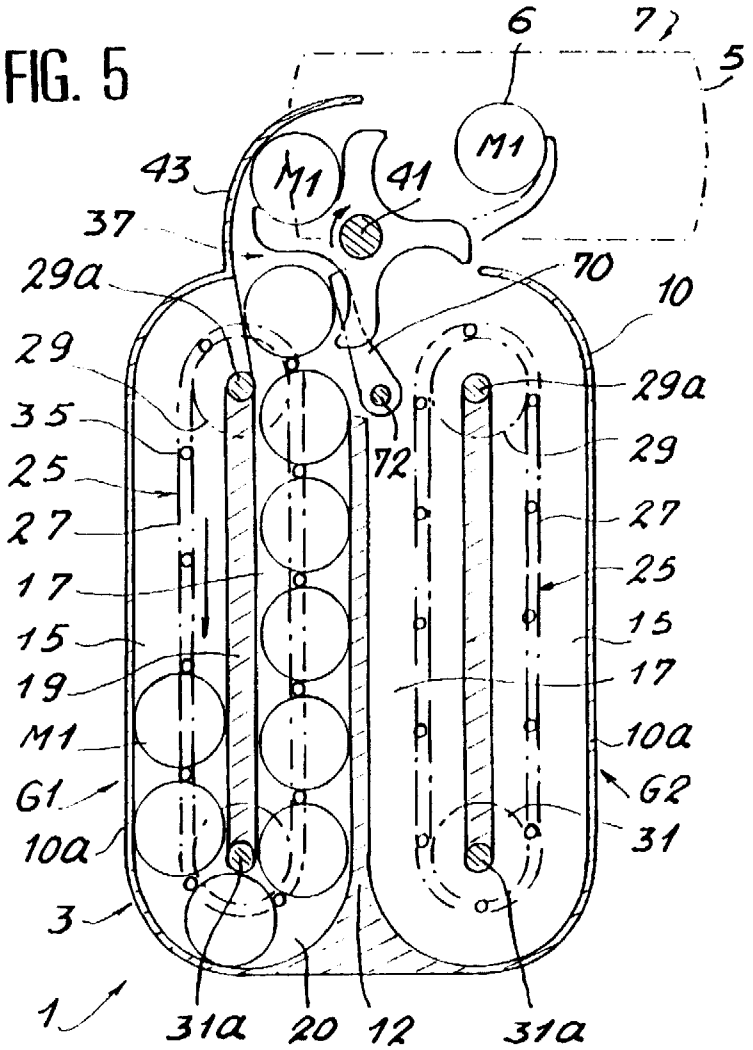
FIG. 5 is a similar view to that of FIG. 2 to illustrate the operation of the other racks.

The feed system 1 shown in FIGS. 1, 2 and 5 comprises a storage device 3 for different munitions M1 and M2, a loading device 5 to introduce the munitions one by one in a loading and firing chamber 6 of a small or medium caliber fire arm 7, and an intermediate device 9 to transfer the munitions M1 and M2 between the storage device 3 and the loading device 5 of the weapon 7.

The representation of the loading device 5 of the weapon has been voluntarily given in skeleton form, given that it is peculiar to the type of weapon under consideration and that the storage device 3 and the intermediate transfer device 9, form an assembly which may work with different types of loading devices.

The storage device 3 given in FIG. 1 comprises a container 10 in the shape of a parallelepiped rectangle. Two racks G1 and G2 containing the munitions M1 and M2 are arranged inside the container 10.

The two racks G1 and G2 are arranged on either side of a central vertical partition 12 which longitudinally separates the inner volume of the container 10 into two parts. The container 10 extends for a length which is greater than that of the munitions M1 and M2.

Two vertical passages, respectively outer 15 and inner 17, are demarcated in each rack G1 and G2 by means of an intermediate vertical wall 19 parallel to the central partition 12.

More specifically, for the rack G1 for example:

the outer passage 15 is demarcated between the longitudinal vertical wall 10*a* of the container 10 which surrounds the rack G1 and the intermediate vertical wall 19 of this rack G1, and the inner passage 17 is demarcated between the intermediate vertical wall 19 of the rack G1 and the central vertical wall 12 which separates the two racks G1 and G2.

The two passages 15 and 17 of the rack G1 are of a width which is slightly greater than the diameter of the munitions which they must store. At their lower ends, the two passages 15 and 17 communicate with each other by a semi-circular part 20 arranged in the bottom wall of the container 10. At their upper ends, the two passages 15 and 17 open out into a same entrance/exit 22 arranged on the upper part of the container 10.

Rack G2 is arranged in an identical manner to rack G1, and the two outer 15 and inner 17 passages of rack G2 also open out, at their upper ends, in the same entrance/exit 22 as those of rack G1.

The munitions M1 and M2 are designed to be stored horizontally on top of each other in the passages 15 and 17 of the two racks G1 and G2, the munitions not being chain-linked together.

Each rack G1 and G2 is fitted with a two-way transport means to support and move the munitions M1 and M2 inside the rack.

In the example of an embodiment illustrated on the different figures, the two-way transport means includes a conveyor 25 having two endless chains 27. The two chains 27 of each conveyor 25 extend in parallel to one another and each winds around, respectively, upper 29 and lower 31 drive wheels. The drive wheels 29 and 31 share each chain 27 in two bits and are arranged so that each bit of the chain 27 may freely move in the outer passage 15 of the relevant rack G1 or G2, whereas the other bit of the chain 27 may freely move in the inner passage 17 of the rack G1 or G2. The two upper drive wheels 29 of the two chains 27 are supported by and are integral in rotation with the same shaft 29*a*, and the two lower drive wheels 31 are also supported by and integral with a common shaft 31*a*, so that the two chains 27 of each conveyor 25 are driven simultaneously. The ends of the shafts 29*a* and 31*a* of each conveyor 25 are housed in bearings 33 supported by the side wall of the container 10, for example.

The two endless chains 27 of each conveyor 25 comprise radial catches 35 which are designed to support the munition M1 or M2.

The intermediate device 9 to transfer the munitions from one of the racks G1 or G2 towards the loading device 5 of the weapon and vice versa also comprises a two-way transport means which includes a starwheel 37.

The starwheel 37 comprises two stars with four points that are supported by and integral in rotation with a bearing shaft 41. The two stars 39 are separated from one another by a distance which is less than the length of the munitions M1 and M2 so as to support the munitions.

The starwheel 37 is mounted in the upper entrance/exit opening 22 of the container 10 to work with the munitions of racks G1 or G2. The shaft 41 carrying the starwheel 37 is supported in rotation by the container 10 and extends in parallel to the shafts 29*a* and 31*a* of the two conveyors 25.

The entrance/exit opening 22 of the container 10 is partly bordered by a casing 43 having the shape of the arc of a circle which partly surrounds the starwheel 37 on the rack G1 side. It is notable that the distance separating the bottom of each point 40 of the stars 39 and the inner wall of the casing 43 is barely greater than the diameter of the munitions M1 and M2.

The starwheel 37 and the conveyors 25 must be controlled simultaneously, knowing that in operation one or other of the racks G1 or G2 is selected.

Means to select and control the starwheel 37 simultaneously with one or other of the conveyors 25 of the two racks G1 or G2 have been provided.

The means comprises at least:

one drive wheel 45 supported by and integral with the shaft 41 of the starwheel 37, one drive wheel 47 connected in rotation with the shaft 29*a* of the conveyor 25 of rack G1 and mobile in translation on the shaft 29*a* by means of a coupling device 48 that may or may not mesh the drive wheel 47 with the drive wheel 45 of the starwheel 37, one drive wheel 49 connected in rotation with the shaft 29*a* of the conveyor 25 of rack G2 and mobile in translation on the shaft 29*a* by means of a coupling device 50 that may or may not mesh the drive wheel 49 with the drive wheel 45 of the starwheel 37, and a single control device 52 which acts on the two coupling devices 48 and 50 so that the drive wheel 45 of the starwheel is neither meshed with one or other of the drive wheels 47 and 49 of the two conveyors 25.

The two coupling devices 48 and 50 are identical and only device 48 is described hereafter.

The coupling device 48 comprises a bush 54 which is mounted sliding on the shaft 29*a* of the conveyor 25 of rack G1 by means of ribbing 56. The drive wheel 47 is supported by and integral with the bush 54.

The control device 52 comprises a rod 58 tipped at each end by a fork 60 which engages in a ring-shaped groove 62 arranged on the periphery of each bush 54. The rod 58 is mounted on a pivot 65 to move in translation the two bushes 54 in two different directions. In this manner, when the drive wheel 47 of the conveyor 25 of rack G1 meshes with the drive wheel 45 of the starwheel 37, the drive wheel 49 of the conveyor 25 of rack G2 is not meshed with the drive wheel 45 of the starwheel 37, and vice versa. In these circumstances, when the starwheel 37 rotates, only one of the conveyors 25 is driven simultaneously with the rotational movement of the starwheel 37.

Figure 6:
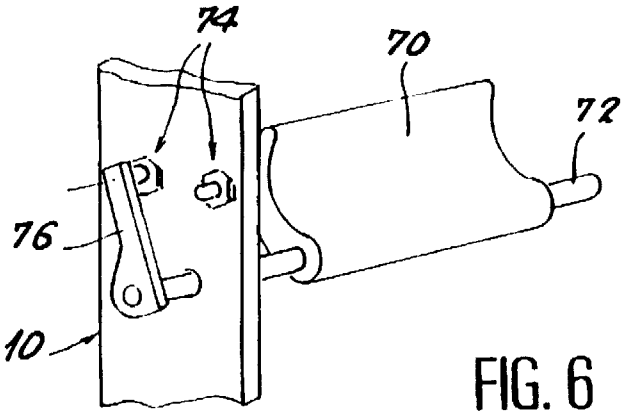
FIG. 6 is a partial perspective view of a detail of FIG. 1 indicated by arrow VI.

Lastly, with reference to FIG. 6, a swivelling guiding flap 70 is located at the entrance/exit opening 22 of the container 10. The flap 70 is positioned under the starwheel 37 and is integral with a shaft 72 which extends in parallel to the shaft 41 of the starwheel 37. The shaft 72 is supported in rotation by the container 10. The flap 70 extends for a length which is less than the distance separating the two stars 39, and may swivel between two positions according to whether rack G1 or G2 is selected. In each of these two positions, the flap 70 is immobilized by at least one ball bearing tappet 74, for example. To this end, the shaft 72 integral with the flap 70 supports a radial lever 76, towards one end, which is designed to work with two ball bearing tappets 74 supported by a wall of the container.

The operation of the feed system will now be described.

In the first place, the munitions M1 are stored in rack G1 and the munition M2 are stored in rack G2. Each rack G1 and G2 is fitted with a trap door (not shown) to load the munitions into the vertical passages respectively outer 15 and inner 17 of each rack G1 and G2. In each passage, a munition M1 or M2 is supported by two catches 35 of the two endless chains 27 of the relevant conveyor 25.

When the weapon is operational, the firer may select rack G1 or rack G2 according to the type of target to be hit. If the firer selects rack G2 to fire munition M2 and the drive wheel 49 of the conveyor 25 of the rack G2 is not meshed with the drive wheel 45 of the starwheel, the firer acts on the control device 52 to mesh the two drive wheels 45 and 49 by swivelling the rod 58. This causes the drive wheel 47 to uncouple from the conveyor 25 of rack G1 and the drive wheel 45 to uncouple from the starwheel 37.

The shaft 41 of the starwheel 37 is controlled in rotation, to drive the conveyor 25 of rack G2 simultaneously with the shaft 41. With reference to FIG. 2, the munitions M2 contained in the outer passage 15 or the exit passage of rack G2 rise and are transported one after the other to the entrance/exit opening 22 in order to be picked up by the points 40 of the starwheel 37 and transferred towards the chamber 6 of the loading device 5 at the firing rate of the weapon. The first munition M2 which exits from the rack G2 puts pressure on one face of the flap 70 to make it swing. The swing of the flap 70 is limited by the ball-bearing tappet 74 located at the side of rack G1. The flap 70 thus enables the munition M2 to be held back, the munition thereafter finds itself under the starwheel 37. The munition M2 partly engages between two axially aligned points 40 of the two stars 39 of the starwheel 37 and is then guided by the casing 43 until the munition M2 moves into the upper part of the starwheel 37 before being ejected towards the loading device 5 of the weapon and loaded in the chamber 6.

At the same time, the munitions M2 contained in the inner passage 17 of rack G2 move down in order to pass into the outer passage 15 with constitutes the exit passage of rack G2.

The rotational movement of the starwheel 37 is controlled by the operational cycle of the weapon. The rotational movement is therefore not continuous, as this movement must be momentarily interrupted during the firing phase of the munition loaded in the chamber 6 of the weapon 7.

When the firer has decided to cease firing munition M2 in order to fire munitions M1, he must firstly bring back the munitions M2 which are possibly in the process of being transferred towards the loading device 5 of the weapon. In order to do that, the firer controls the shaft 41 of the starwheel 37 by rotating it in the opposite direction to bring the munitions M2 back to rack G2.

Afterwards, to select rack G1, the firer acts on the control device 52 to simultaneously drive the starwheel 37 and the conveyor 25 of rack G1, i.e. to couple the drive wheel 45 of the starwheel 37 and the drive wheel 47 of the conveyor 25 of rack G1. Finally, the firer activates the rotation of the shaft 41 of the starwheel 37 to drive the conveyor 25 of rack G1. The munitions M1 rise and exit rack G1 by the inner passage 17, whereas the munitions M1 of the outer passage 15 move down and thereafter pass into the inner passage 17 or exit passage. The first munition M1 which exits from rack G1 pushes the flap 70 and makes it swing towards its other position where it is immobilized by the ball-bearing tappet 74 located at the side of rack G2. As above, the casing 43 enables the munitions M1 to be guided between the lower and the upper parts of the starwheel 37.

When rack G1 is selected, the flap 70 merely functions as a guide for the munitions M1. In fact, the inner passage 17 of rack G1, which acts as an exit passage, is located roughly opposite the starwheel 37. On the other hand, when rack G2 is selected, the flap 70 functions as a support to hold back the munitions M2 Given that the outer passage 15 of exit passage is axially offset with respect to the starwheel 37.

The reversible operation of the starwheel 37 supposes that its position and dimensions, in particular of the points 40 of the stars 39 as well as the shape of these points, are precisely calculated according to the diameter of the munitions M1 and M2 on the one hand, and take into account the fact that the munitions M1 of rack G1 exit via the inner passage 17, whereas the munitions M2 of rack G2 exit via the outer passage 15.

The invention is naturally not limited to the embodiment described above. In particular, the means to select rack G1 or G2 and the means to simultaneously control the starwheel 37 with the conveyor 25 of the selected rack may by replaced by means which are their technical equivalent.

We claim:

1. An ammunition feed system for a fire arm having a loading device for loading munitions in a firing chamber, said feed system comprising:

a munitions storage single container containing a first ammunition rack capable of containing a first type of munitions and a second ammunition rack capable of containing a second type of munitions, each of said first and second ammunition racks being operably connected to a two-way conveyor that supports and moves associated munitions along an associated ammunition rack; and an intermediate transfer device common to the first and second ammunition racks, said intermediate transfer device comprising a single starwheel configured to directly contact and selectively transfer a round of each of the first and second types of munitions while each said round is in said first and second ammunition racks.

2. A feed system according to claim 1, wherein the single starwheel is supported by a shaft, and the conveyor of each of the first and second racks comprises an endless chain conveyor.

3. A feed system according to claim 2, wherein each of the first and second racks comprises a vertical outer passage, a vertical inner passage parallel to the vertical outer passage, and an intermediate partition disposed between the inner and outer passages, the inner and outer passages communicating with each other at lower ends thereof and upper ends thereof along a common opening of the container.

4. A feed system according to claim 3, wherein the single starwheel is located near the common opening and is configured to cooperate with munitions from the selected rack.

5. A feed system according to claim 4, wherein the common opening is partly bordered by a casing to guide munitions supported by the single starwheel.

6. A feed system according to claim 4, further comprising a swinging guiding flap located near the common opening, the flap being positioned between the first and second munitions racks and under the single starwheel to guide the selected munitions, wherein the flap takes up a selected position according to the selected rack and swings towards the selected position when the selected munitions exit from the selected rack.

7. A feed system according to claim 3, wherein each two-way conveyor comprises:

at least one roller pair including an upper drive wheel and a lower drive wheel;

an endless chain wound around the upper and lower drive wheels, the endless chain moving in the outer and inner passages of a corresponding rack and being fitted with catches to support corresponding munitions.

8. A feed system according to claim 7, wherein the at least one roller pair includes two roller pairs, and wherein the upper drive wheels of each two-way conveyor are supported by and integral with a first common drive shaft, and wherein the lower drive wheels of each two-way conveyor are supported by and integral with a second common shaft, and further wherein the first and second common drive shafts extend parallel to the shaft of the single starwheel.

9. A feed system according to claim 1, further comprising a controller to control the intermediate transfer device to cooperate simultaneously with a selected two-way conveyor of one of the first and second ammunition racks.

10. A feed system according to claim 9, wherein the controller comprises a drive wheel supported by and integral with a shaft of said single starwheel, two drive wheels working with respective ones of the two-way conveyors via coupling devices, and a common control device to act on each of the coupling devices so as to mesh the drive wheel of the single starwheel with the selected one of the drive wheels of the selected two-way conveyor.

11. A feed system according to claim 10, wherein coupling device comprises a bush slidingly mounted via ribbing on a drive shaft of a corresponding two-way conveyor, the bush supporting a drive wheel of the corresponding two-way conveyor.

12. A feed system according to claim 11, wherein the control device comprises a rod that connects each bush, the rod being hinged on a pivot to move each bush in translation in opposite directions.

13. A feed system according to claim 1, wherein said intermediate transfer device is also configured to return the first selected munitions type to the selected rack when a second selected munitions type is to be transferred towards the loading device.

14. An ammunition feed system for a fire arm having a loading device for loading munitions in a firing chamber, said feed system comprising:

a munitions storage container containing a first ammunition rack capable of containing a first type of munitions and a second ammunition rack capable of containing a second type of munitions, each of said first and second ammunition racks being operably connected to a two-way conveyor that supports and moves associated munitions along an associated ammunition rack; and two-way transport means common to the first and second ammunition racks, said two-way transport means comprising a single starwheel configured to directly contact and selectively transfer a round of each of the first and second types of munitions while each said round is in said first and second ammunition racks.

15. A feed system according to claim 14, wherein said two-way transport means is also capable of returning the first selected munitions type to the associated rack when a second selected munitions type is to be transferred towards the loading device.

16. A feed system according to claim 14, further comprising means for controlling the two-way transport means simultaneously with a selected two-way conveyor of one of the first and second ammunition racks.

17. A method for feeding munitions between a single munitions container and a firing chamber of a fire arm, said method comprising:

storing at least two types of munitions in a container having a first ammunition rack capable of containing a first type of munitions and a second ammunition rack capable of containing a second type of munitions; and using a single starwheel, directly contacting and selectively transferring a round of each of the first and second types of munitions while each said round is in said first and second ammunition racks.

18. A method according to claim 17, further comprising returning the first selected munitions type to the associated rack using the single starwheel when a second selected munitions type is to be fed towards the loading device with the single starwheel.

19. A method according to claim 17, wherein each of the first and second ammunition racks includes a two-way conveyor, and wherein the method further comprises controlling the single starwheel simultaneously with a selected two-way conveyor of one of the first and second ammunition racks.

20. An ammunition feed system for a fire arm having a loading device for loading munitions in a firing chamber, said feed system comprising:

a munitions storage single container containing a first ammunition rack capable of containing a first type of munitions and a second ammunition rack capable of containing a second type of munitions, each of said first and second ammunition racks being operably connected to a two-way conveyor that supports and moves associated munitions along an associated ammunition rack; and an intermediate transfer device common to the first and second ammunition racks, said intermediate transfer device being configured to transfer a first selected munitions type of the first and second types of munitions from a selected rack of the first and second racks towards the loading device, wherein the intermediate transfer device includes a starwheel supported by a shaft, and the conveyor of each of the first and second racks comprises an endless chain conveyor, wherein each of the first and second racks comprises a vertical outer passage, a vertical inner passage parallel to the vertical outer passage, and an intermediate partition disposed between the inner and outer passages, the inner and outer passages communicating with each other at lower ends thereof and upper ends thereof along a common opening of the container, wherein each two-way conveyor comprises:

at least one roller pair including an upper drive wheel and a lower drive wheel, and an endless chain wound around the upper and lower drive wheels, the endless chain moving in the outer and inner passages of a corresponding rack and being fitted with catches to support corresponding munitions, and wherein the at least one roller pair includes two roller pairs, and wherein the upper drive wheels of each two-way conveyor are supported by and integral with a first common drive shaft, and wherein the lower drive wheels of each two-way conveyor are supported by and integral with a second common shaft, and further wherein the first and second common drive shafts extend parallel to the shaft of the starwheel.

21. An ammunition feed system for a fire arm having a loading device for loading munitions in a firing chamber, said feed system comprising:

a munitions storage single container containing a first ammunition rack capable of containing a first type of munitions and a second ammunition rack capable of containing a second type of munitions, each of said first and second ammunition racks being operably connected to a two-way conveyor that supports and moves associated munitions along an associated ammunition rack;

an intermediate transfer device common to the first and second ammunition racks, said intermediate transfer device being configured to transfer a first selected munitions type of the first and second types of munitions from a selected rack of the first and second racks towards the loading device; and a controller to control the intermediate transfer device to cooperate simultaneously with a selected two-way conveyor of one of the first and second ammunition racks, wherein the controller comprises a drive wheel supported by and integral with a shaft of a starwheel, two drive wheels working with respective ones of the two-way conveyors via coupling devices, and a common control device to act on each of the coupling devices so as to mesh the drive wheel of the starwheel with the selected one of the drive wheels of the selected two-way conveyor.

* * * * *